US008408408B1

(12) United States Patent
Dumm

(10) Patent No.: US 8,408,408 B1
(45) Date of Patent: Apr. 2, 2013

(54) NIPPLE ASSEMBLY AND MOUNTING TOOLS

(76) Inventor: Richard H. Dumm, Windsor, CO (US)

( * ) Notice: Subject to any disclaimer, the term of this patent is extended or adjusted under 35 U.S.C. 154(b) by 825 days.

(21) Appl. No.: 12/584,551

(22) Filed: Sep. 8, 2009

(51) Int. Cl.
*A61J 17/00* (2006.01)

(52) U.S. Cl. ..... 215/11.1; 215/11.2; 215/11.3; 215/11.4; 215/11.5; 215/11.6; 119/71; 119/72.5

(58) Field of Classification Search ..... 215/11.1–11.6; 119/71, 72.5, 72, 51.5; 604/183, 184, 185–187
See application file for complete search history.

(56) References Cited

U.S. PATENT DOCUMENTS 2,190,420 A 2/1940 Frederick et al.
2,280,410 A 4/1942 Keltner
2,329,347 A 9/1943 Graham
2,522,757 A * 9/1950 Larson ..... 119/71
2,697,531 A 12/1954 Hood
2,708,421 A * 5/1955 Jauch ..... 119/71
2,748,047 A 5/1956 Kuss
2,939,598 A 6/1960 Donleavy
3,549,036 A * 12/1970 Ritsi ..... 215/11.6
5,378,065 A 1/1995 Tobolka
5,638,769 A * 6/1997 McIntyre et al. ..... 119/71

OTHER PUBLICATIONS

U.S. Appl. No. 12/584,552, copending.

* cited by examiner

*Primary Examiner* — Anthony Stashick
*Assistant Examiner* — Cynthia Collado
(74) *Attorney, Agent, or Firm* — Albert Haegele; Leyendecker & Lemire, LLC

(57) ABSTRACT

Nipple assemblies including nipples which attach to a threaded nipple adapter which can be attached to feeding containers with threaded spouts are disclosed. Mounting tools are also disclosed, to aid in attaching the elastic nipples to the adapters.

1 Claim, 16 Drawing Sheets

NIPPLE ASSEMBLY AND MOUNTING TOOLS

REFERENCE TO RELATED APPLICATIONS

This application is related to Applicant's copending application Ser. No. 12/584,552 for "FLEXIBLE HEAT TREATMENT AND STORAGE BAG," filed simultaneously with the present application, which is incorporated herein by reference in its entirety.

BACKGROUND OF THE INVENTION

1. Field of the Invention

The embodiments disclosed herein pertain to nipple assemblies for dispensing liquids to mammals such as young animals, including means for attachment to containers of such liquids and to tools for mounting nipples to nipple adapters to form a nipple assembly.

2. Description of the Relevant Art

Applicant's prior U.S. Pat. Nos. 6,276,264 (PORTABLE DAIRY PASTEURIZER) and 7,401,546 (BATCH PASTEURIZER) and pending application U.S. Ser. No. 11/519,758 for a HEAT EXCHANGER UNIT, published as US 2008/0063771 and now abandoned, all pertain to the heat treatment or pasteurization of dairy products for the feeding of young animals, and are incorporated herein by reference.

Prior art patents disclose numerous containers and systems for storing, handling and dispensing liquids such as dairy products, particularly systems for feeding calves and other young animals.

For example, U.S. Pat. No. 2,190,420 discloses a calf feeder with a nipple, hanger and check valve, made of rubberized canvas.

U.S. Pat. No. 2,329,347 discloses a calf feeder with a hanger and nipple, made of sheet rubber.

U.S. Pat. No. 2,708,421 discloses a collapsible dispensing/feeding device made of waterproof fabric, rubber, etc., having a nipple and a funnel-type filler.

U.S. Pat. No. 2,280,410 discloses a collapsible nursing bag for calves or other young animals, having multiple teats with anti-leak valves and made of sheet rubber.

U.S. Pat. No. 2,748,047 discloses collapsible bags made of flexible plastic which can be used as nursing bags or for carrying/storage.

Even though a variety of containers for the storage and dispensing of liquids, including the feeding of dairy products to young animals, have been patented and produced, numerous problems remain to be solved and improvements are needed in the field. As stated in Applicant's previous patents, significant improvements in the health of young animals such as calves can be achieved by ensuring that any waste milk, colostrum or other dairy products are pasteurized prior to feeding. However, pasteurizing such products may be insufficient; for example, if a product is pasteurized and then transferred via unsanitary means it will be recontaminated with pathogenic microbes, or if a calf is able to remove the nipple from a feeding container while suckling, the contents will be wasted and/or contaminated. With conventional processing, small quantities of dairy products may be kept in non-refrigerated conditions awaiting adequate volumes to accumulate for a batch to be pasteurized; such problems could be eliminated by collecting the product in small, sealed containers for prompt pasteurization or cooling. Also, since most containers are difficult to clean thoroughly after containing dairy products, it would be desirable to have sanitary, convenient containers which can be configured for one-time use in storing and feeding such products. Further details of such problems in he dairy industry are provided in the background section of Applicant's copending application RHD-5.

SUMMARY

One aspect of the disclosed embodiments is feeding attachments such as nipples for removable attachment to feeding containers for nursing young animals. Another aspect of the disclosed embodiments is apparatus and methods for efficiently attaching and detaching such nipples to and from the feeding containers. Still another aspect of these embodiments concerns methods of connecting the nipples to the containers using threaded connections which minimize the possibility of leakage. A further aspect is the use of the containers disclosed in Applicant's copending application RHD-4 for feeding dairy products or other liquids, which may be pasteurized, to young animals such as calves using feeding fixtures such as nipples.

A general embodiment is a connector and feeding fixture assembly, comprising a connector component forming a liquid conduit and having on one end means for connection to a spout of a liquid container and on the opposite end, means for connection to a feeding fixture, plus a feeding fixture adapted for connection to the outer end of the connector component. A version of this embodiment comprises a female-threaded receptacle for connection to male threads on the spout of a container and a male barb fitting adapted to connect to a female receptacle affixed to the base of a feeding fixture. The feeding fixture can be a nipple, and the nipple can comprise handling means attached to the base thereof which have at least two portions which are grippable for the connection of the nipple base to the connector component or removal therefrom.

The containers of RHD-4 comprise spouts with male threads. Various useful fixtures can be attached to the spout, including specialized pouring means and nipple assemblies. One embodiment usable with such containers is a nipple assembly comprising a nipple and a threaded nipple adapter. An embodiment of such a nipple assembly comprises a nipple having a flexible elastic body which can be provided with a suitable aperture in its tip for dispensing liquid to a nursing animal and a base comprising a beveled interior opening and handle means at the base thereof for forcing the nipple base onto a conical barb fitting forming one end of the nipple adapter. The nipple adapter has a hollow interior forming a liquid conduit and female threads at one end therein designed to attach to the threaded spout of a feeding container to place the nipple in fluid communication with the spout. The nipple adapter can comprise a substantially circular flange on the base hereof to facilitate screwing and unscrewing the adapter to and from a threaded spout. To improve the operators grip, the flange can have a plurality of small finger grip projections along the periphery hereof, or can be knurled or otherwise roughened around the outer edge. A feeding container such as the bags disclosed in Applicant's RHD-4 can be filled with liquid, then have the screw cap removed and a feeding fixture such as a nipple threaded onto the spout in place of the cap to provide a "nursing bag" ready for feeding a young animal.

Mounting tools are provided to facilitate the assembly and disassembly of the components of the nipple assembly described above (a nipple and nipple adapter), comprising means for at least temporary attachment to a surface. The body of such a tool can be any suitable shape, but can be easily produced in a substantially boxy, rectangular form. The tools can have feet or brackets at their bases which contain holes, slots or the like for the insertion of mechanical fasteners such as bolts, sheet metal and/or wood screws, nails, pegs, pins or any fastener suitable to join the mounting tool to a given surface. The tools provide means for the removable attachment of the base of the nipple adapter with its barb fitting facing outward for connection of the base of the nipple to the barb fitting for use. For nipple adapters provided with a flange at the base thereof, the mounting tools can provide at least one slot on the top and/or side surfaces hereof to accommodate such flanges, preferably providing a snug fit so that the flange will remain stationary while the nipple is attached or detached. Such slots can vary in width so that the flange can be wedged into a snug fit. When such slots are defined by a substantially continuous outer portion of the mounting tool and the inner box form of the tool, a semi-circular cutout in the outer portion can serve to accommodate the base portion of the nipple adapter to more effectively retain it in position. If such slot are positioned on at least one side of the mounting tool, a conical centering post having a size and shape designed to accommodate the threaded interior of a nipple adapter can be provided for attachment of the nipple to the adapter. By centering the adapter atop the centering post, the nipple can be attached by simply pressing its base down onto the barb fitting of the adapter, using handles or other handling means to exert suitable pressure to mate the nipple base to the barb fitting. The nipple can be removed by again sliding the flange of the nipple adapter of a nipple assembly into the slot and exerting pressure on one side of the nipple, preferably through handling means which provide some rotational force to begin the separation of the nipple from the barb fitting at one side hereof. A simple form of the slot on the mounting tool can be formed by two or more "lift resistors" formed by sheet portions arching from the sides of the body of the tool over a flat surface hereof to define a slot between the inner surfaces of the arching sheet portions and the flat surface of the tool body.

A simplified embodiment of he nipple described above can comprise female threads inside the base hereof in place of the structures designed to affix the nipple base to a barb fitting. The interior threaded nipple can then be screwed directly onto a threaded spout of feeding containers such as those disclosed in Applicant's RHD-4, or can be sized to be removably attached to any suitable container with a threaded spout or mouth. Such threaded nipples can also be provided with handling means such as the handles described above, or other means to facilitate the process of screwing and unscrewing the nipples onto and from a threaded spout or the like.

A further embodiment provides a method or process of feeding a young animal with a dairy product pasteurized using a process described above and in RHD-4, comprising steps of placing a quantity of at least one dairy product in at least one container as described above, pasteurizing the product(s) by immersion in a heat transfer liquid in apparatus which subjects the heat transfer liquid to a temperature-time profile which provides a pasteurization profile for the product(s), cooling the product(s) to suitable feeding temperature(s) and/or heating them to suitable feeding temperature(s) after cold storage, applying a nipple assembly to the spout of the container, tipping it at a suitable angle and inserting the nipple into the animal's mouth for feeding. The nipples to be used are designed for efficient suckling by the animals to be fed, but in some cases pressure can be exerted on the container to induce flow.

BRIEF DESCRIPTION OF THE DRAWINGS

A more complete appreciation of the disclosed embodiments and many of the aspects and advantages thereof will be readily obtained by perusal of the following detailed description and appended claims in combination with the accompanying drawings, with the same parts being designated by the same numerals in the several views, wherein:

DETAILED DESCRIPTION OF PREFERRED EMBODIMENTS

Although a preferred embodiment has been designed for dispensing pasteurized milk and other dairy products to young animals such as calves on dairy farms and the like, and the invention will be discussed in that context, systems within the scope of the invention can be used for the dispensing or feeding of all sorts of liquid materials. The fluids will normally be liquids of low to moderate viscosity such as milk, but can also be more viscous dairy products such as colostrum, cream or dairy beverages.

Naturally, the characteristics of the materials to be dispensed or fed to young animals must be studied and understood before effective dispensing can begin. For example, it is necessary for each product to determine the temperatures for heat treatment, storage and feeding, as well as the size and shape of the aperture in the tip of the nipple through which the product must flow.

In the present application, the contraction "and/or" is used in the conventional sense, with "A and/or B" meaning that A, B or A+B may be present. The embodiments described herein use earth as a frame of reference, wherein "up" is a direction opposite the gravitational force and the "top" or "bottom" of an object being described relate to the normal position in which the object is used. "Outer" and "inner" and "distal" and "proximal" may be used in similar ways to denote the portions farther or nearer from the point of description.

Figure 1:
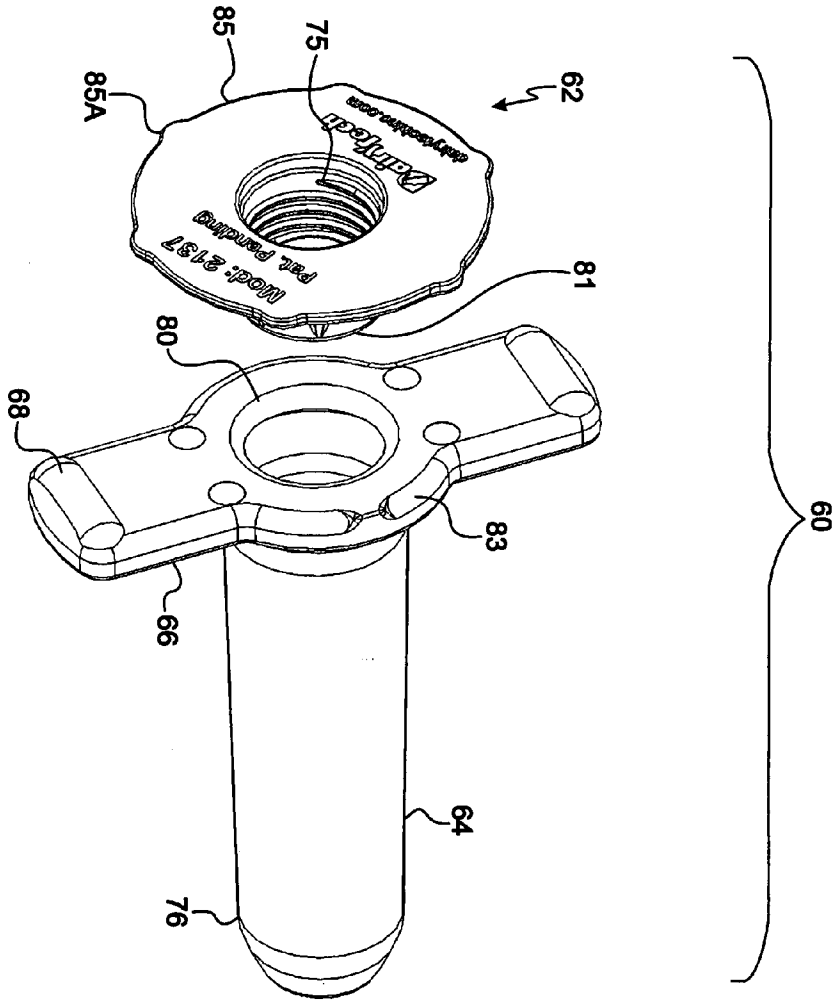
FIG. 1 is an exploded perspective view of a nipple assembly.
Figure 2:
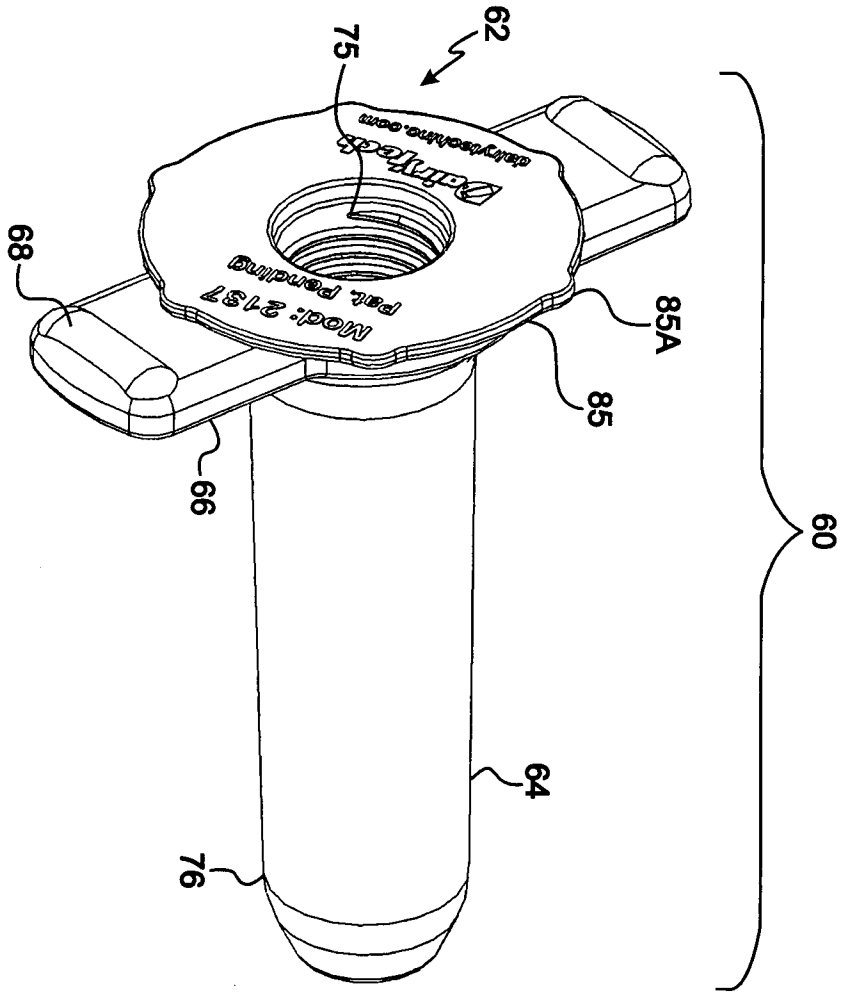
FIG. 2 is a perspective view of the nipple assembly of FIG. 1 with the components joined.
Figure 3:
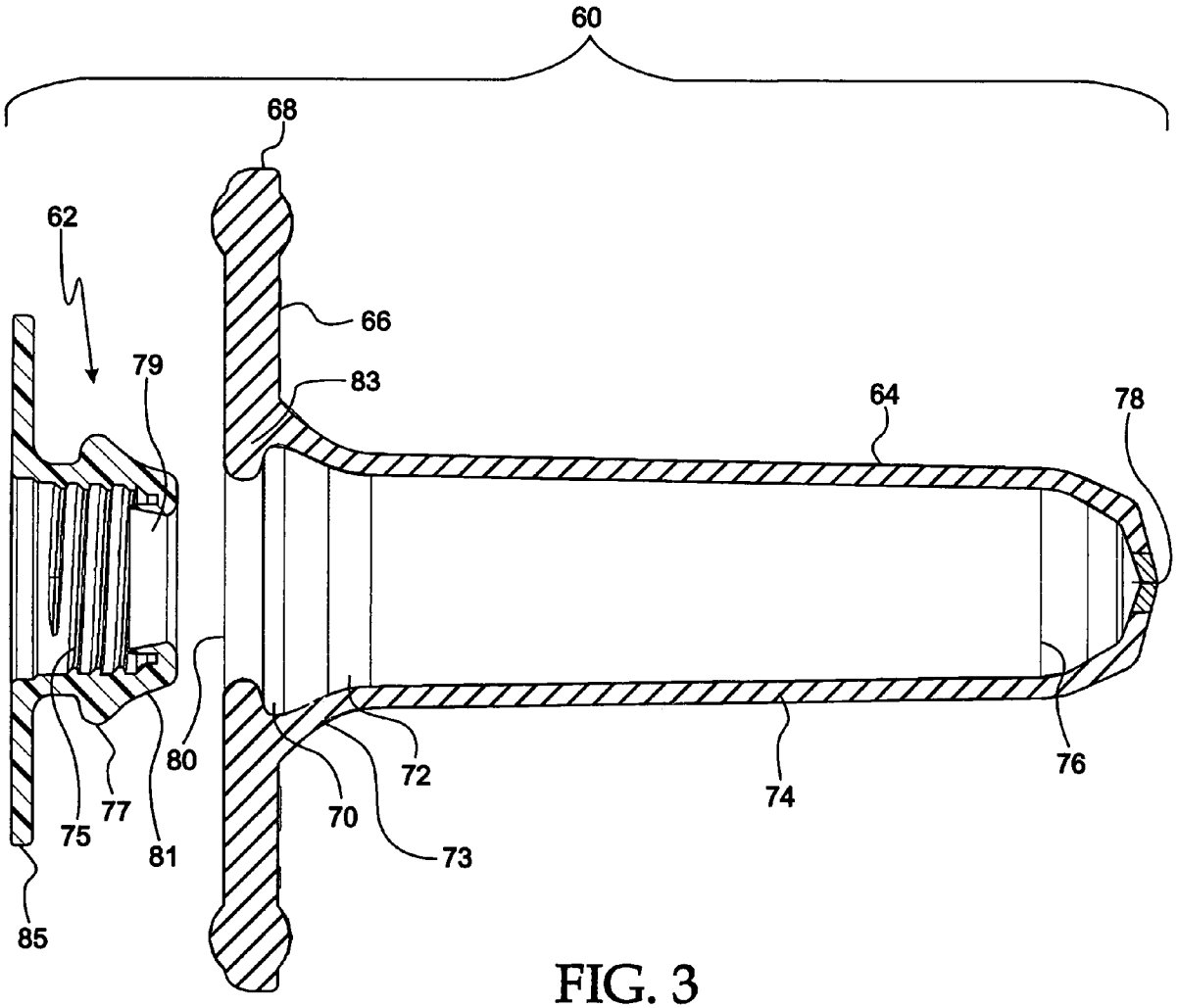
FIG. 3 is an exploded side sectional view of the nipple assembly of FIG. 2, with the nipple adapter attached.
Figure 12:
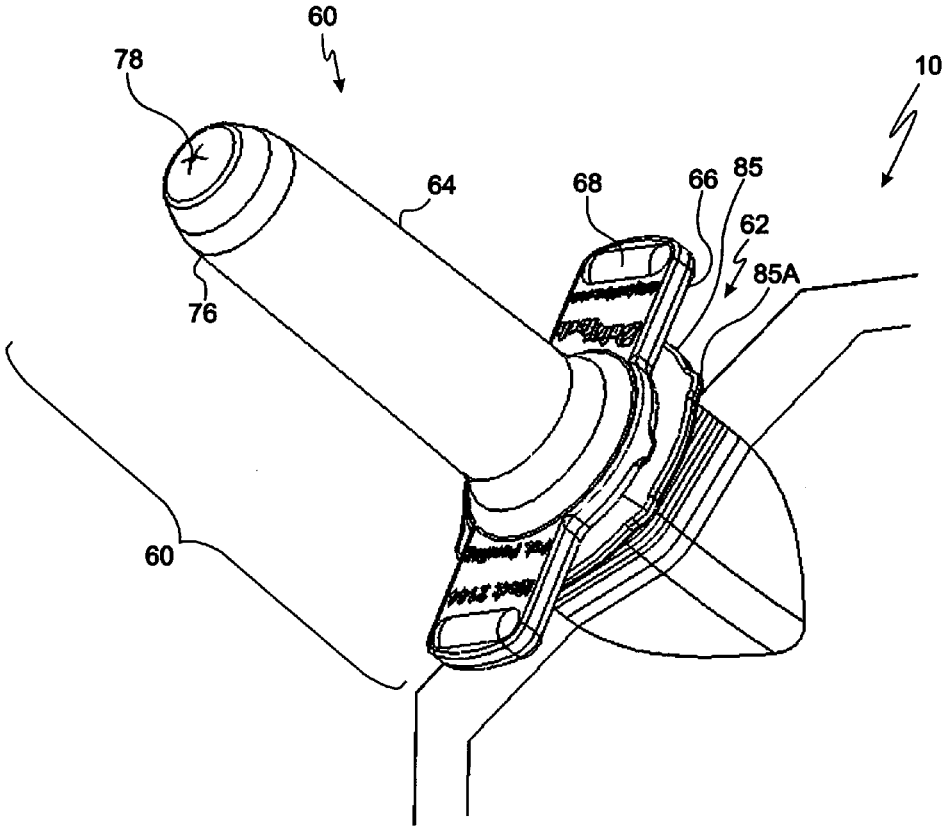
FIG. 12 is a detail view of the threaded spout area of a feeding bag with a nipple assembly attached for feeding young animals.

Turning now to the drawings, FIGS. 1, 2 and 3 illustrate the components of a nipple assembly 60, including nipple 64 and a nipple adapter 62 with internal threads 75 a one end for attachment to the threaded spout 23 of a container 10 (no shown here; see FIG. 12). Nipple adapter 62 can be made of a harder rubber or a suitable synthetic polymer such as ABS (acrylonitrile-butadiene-styrene), filled or unfilled. Nipple 64 has a round, slightly tapered shaft with a wall 74 of flexible rubber or other suitable polymer (as described above), a rounded tip beginning at transition line 76 and at least one aperture 78 at the tip for dispensing the liquid. The aperture 78 can be cut into the molded nipple by cutting at least one single, crossed or crescent-shaped slit with a knife or similar tool to facilitate liquid flow requirements for various liquid products. The nipple wall 74 has a thickened transition 73 from the sealing area 72 and at least one sealing recess 70 to mate with projecting sealing edge 77 of the barb fitting end 81 of nipple adapter 62.

The nipple portion 64 of nipple assembly 60 includes an integral pair of handles 66, attached to a thickened structural base 83, with raised thumb grip ridges 68 on each side for the operator's use in forcing the beveled interior portion 80 of the nipple base 72 over the barb fitting 81 and sealing ledge 77 of the barb fitting of adapter 62 to ensure a tight, secure attachment, as shown in FIG. 2. Nipple adapter 62 has internal threads 75 designed to screw onto the threads 25 of spout 23 of a feeding container (not shown here.) Flange 85 of nipple adapter 62 includes a plurality of projections 85A along its periphery.

FIG. 3 shows the interior structure of nipple adapter 62, including threads 75 and integral seal 79, designed to prevent liquids from escaping around the threads. Seal 79 is formed as a tapered cylindrical component inside threads 75 so that it enters the inside neck of spout 23 when nipple adapter is screwed thereon. This type of fitting is a preferred version because it minimizes leakage.

Figure 4:
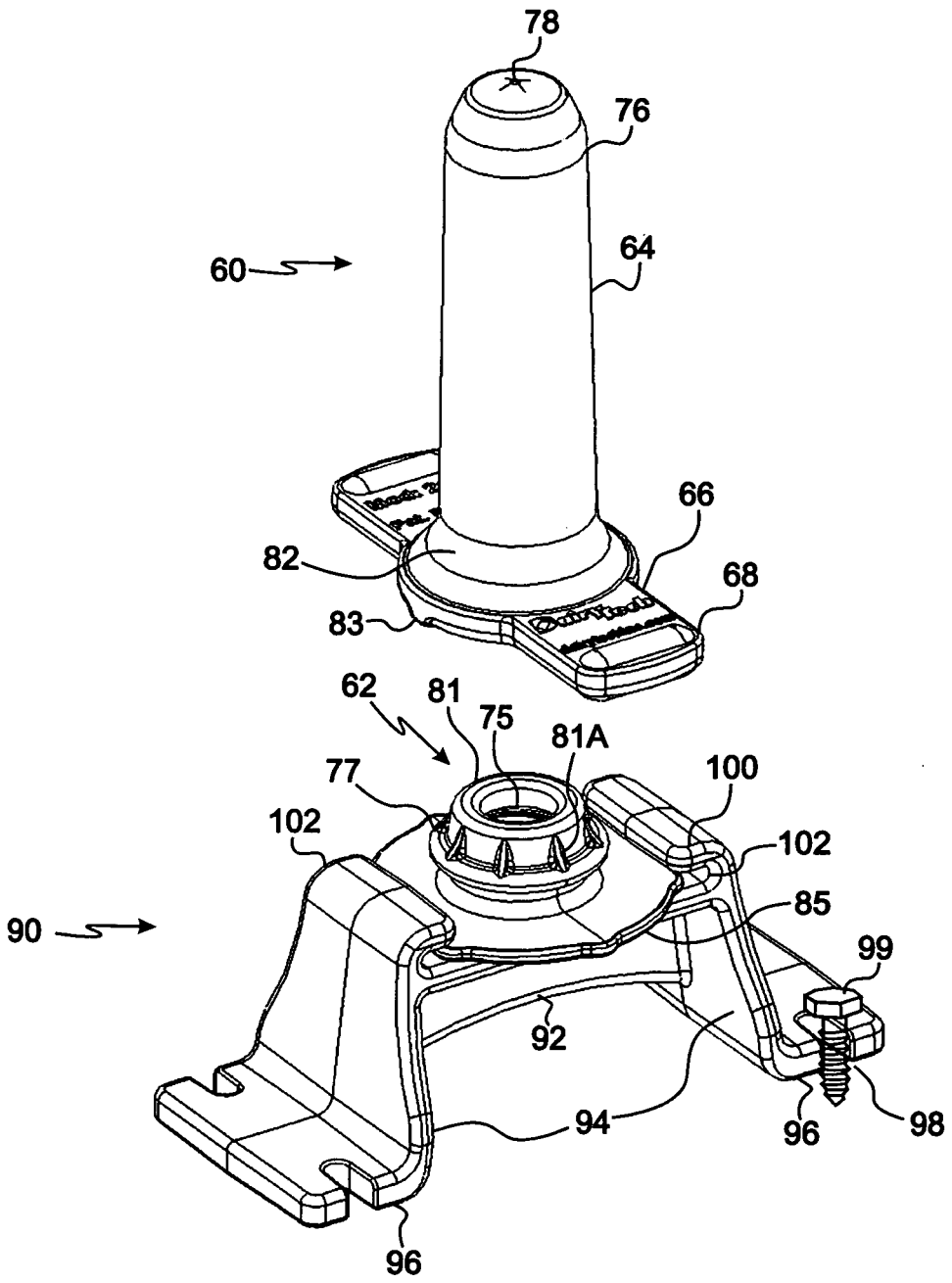
FIG. 4 is a side perspective view of the nipple assembly of FIG. 1 positioned above a mounting tool.

FIG. 4 shows the nipple 60 of FIGS. 1-3 positioned above a nipple adapter 62 which has been inserted into a flange slot 102 of a nipple assembly mounting tool 90. Mounting tool 90 features a bridge support 92 attached to two vertical supports 94, each of which have two mounting hardware slots 98 or the like. These feet and slots, holes or the like to accommodate mounting hardware, are used to secure the tool 90 to a suitable flat surface for use. A representative fastener, in this case a lag bolt 99, is shown, but any suitable mechanical means can be used to secure the tool's base to a surface for working. For example, combinations of hook-and-loop fabrics, strong magnets and any type of mechanical fastener capable of securing the base to a surface can be used. A nipple adapter flange slot 102 is formed by the space between bridge support 92 and two lift resistors 100 which arch inward from both sides of the tool to form a slot adapted to snugly fit nipple adapter flange 85 of nipple adapter 62. In the nipple adapter 62 shown here positioned in flange slot 102, sealing ledge 77 and internal threads 75 of adapter 62 are visible.

Figure 5:
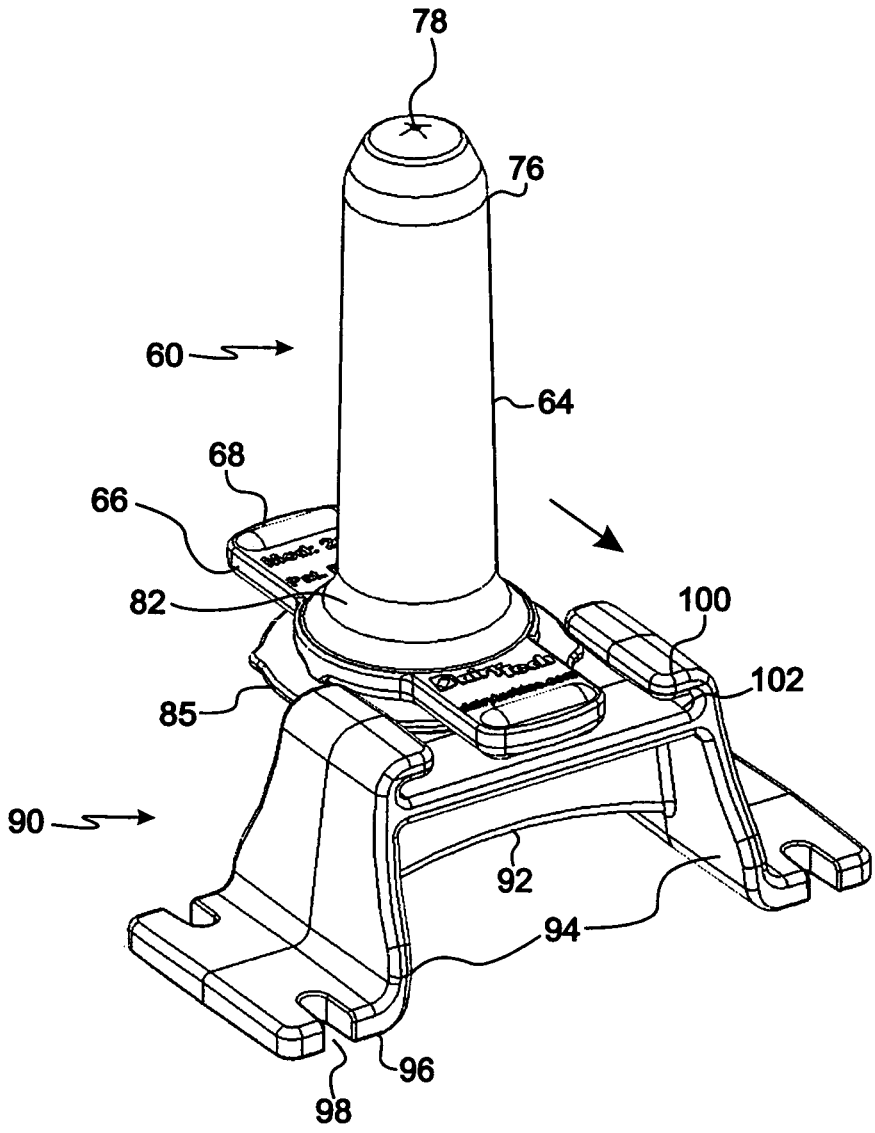
FIG. 5 is a detail view of the base of the nipple assembly of FIG. 1 being slid into a flange slot of the mounting tool of FIG. 4.

FIG. 5 illustrates the process of sliding flange 85 of nipple adapter 62 into the nipple adapter flange slot 102 of mounting tool 90. While this structure has been found to be effective in securing a nipple adapter 62 in place for the installation of nipple 60, any suitable mechanical means including such a flange, clamps or the like can be employed.

Figure 6:
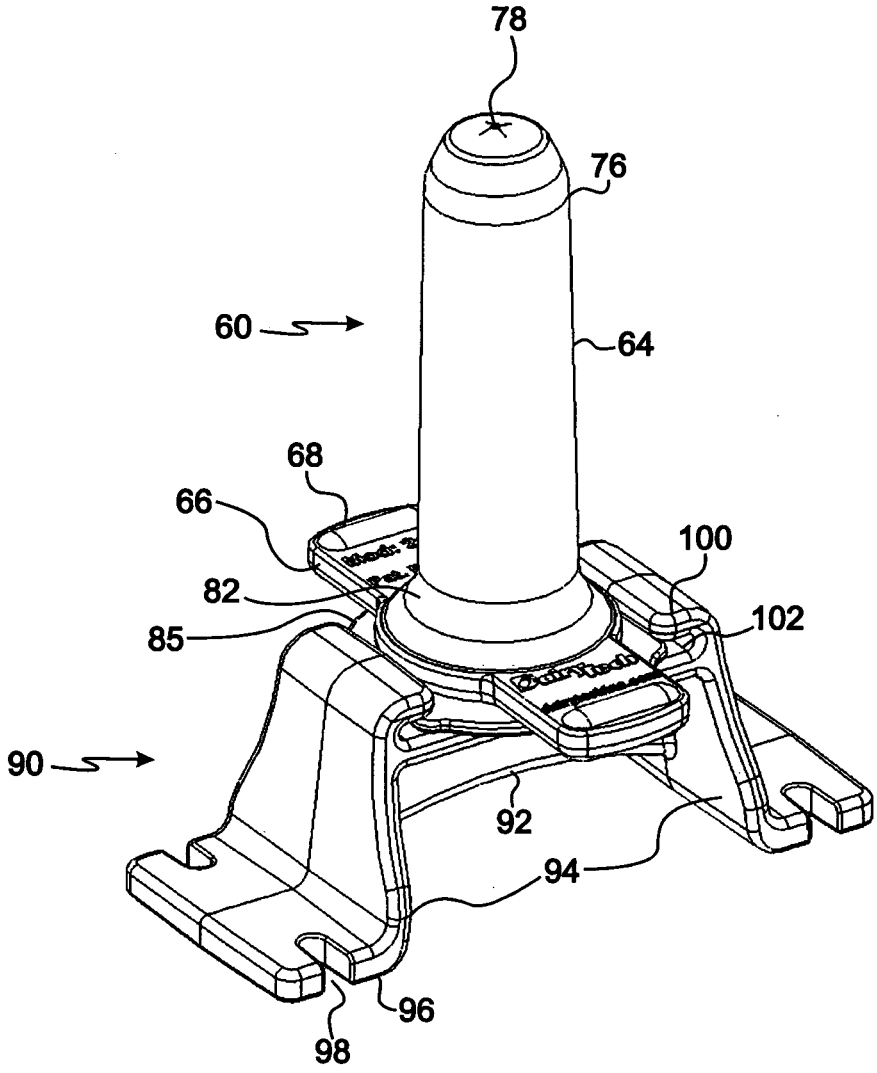
FIG. 6 is a perspective view of the nipple assembly of FIG. 5 attached to the mounting tool of FIG. 5.

As discussed above in FIGS. 1 to 3, nipple 64 can be joined to nipple adapter 62 to form nipple assembly 60 by pressing the nipple downward onto sealing ledge 77 of the barb fitting 81 of the adapter. Securing nipple adapter 62 in mounting tool 90 facilitates this process, allowing the operator to press downward on nipple 64 using handles 66 and thumb grips 68. FIG. 6 shows the nipple 64 thus mounted on nipple adapter 62 to form a nipple assembly 60, which can then be removed by sliding flange 85 of the nipple adapter out of slot 102. As discussed in Applicant's copending RHD-4 and below with regard to FIG. 12, the nipple assembly can then be attached to a threaded spout of a heat treatment, storage and feeding bag or any suitable container having a screw spout of the proper size and threads. Nipple 64 can be removed from nipple adapter 62 by again sliding flange 85 into slot 102 and using handles 66 to pull nipple 64 away from adapter 62.

Figure 7A:
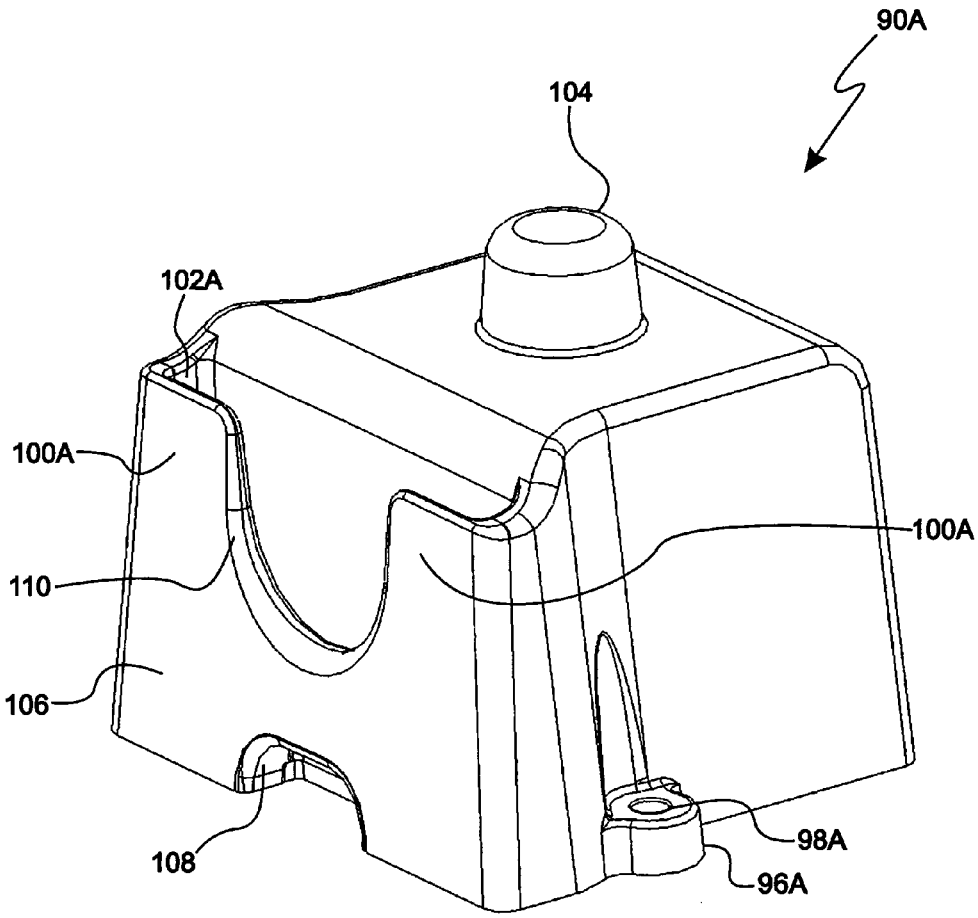
FIG. 7A is a side perspective view of an alternative mounting tool.
Figure 7B:
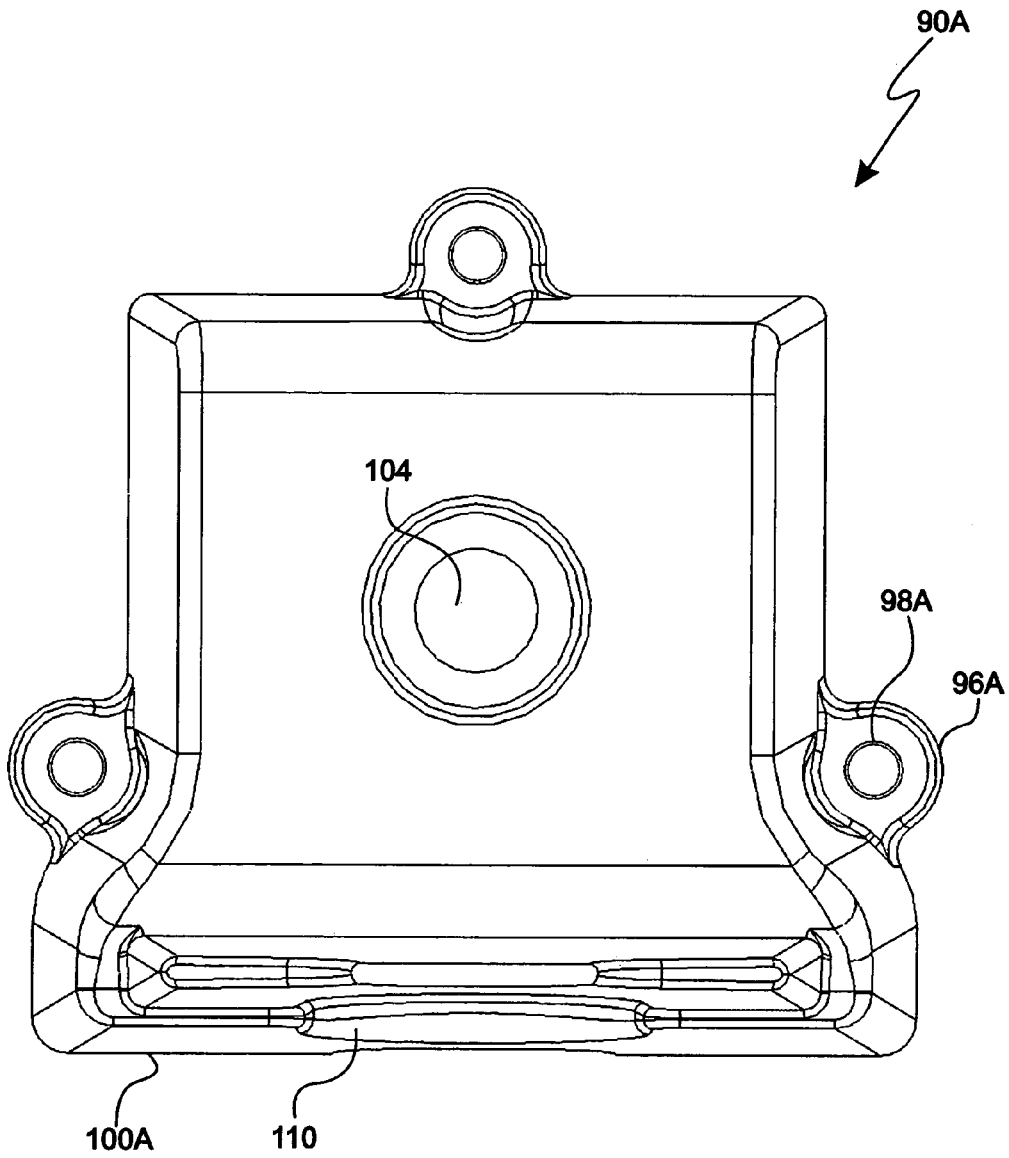
FIG. 7B is a top view of the mounting tool of FIG. 7A.
Figure 7C:
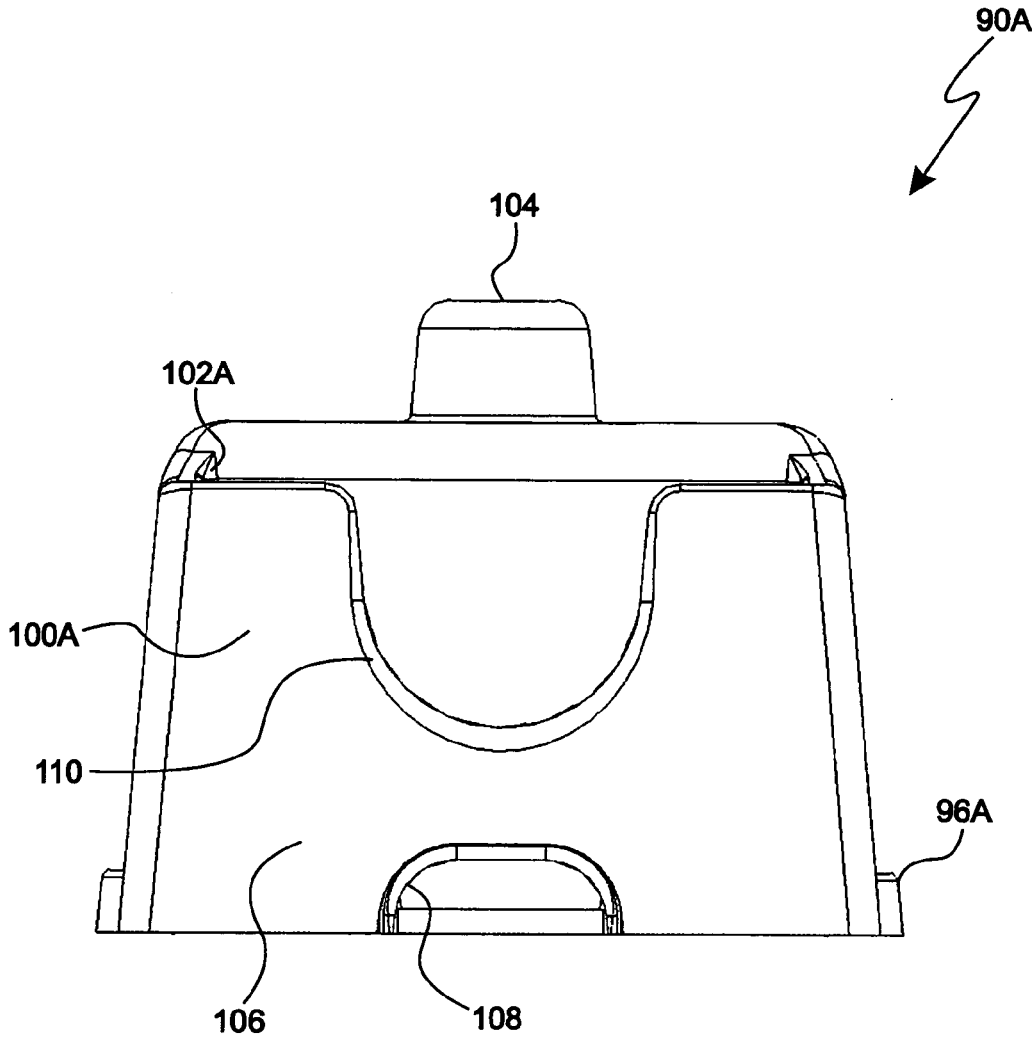
FIG. 7C is a face view of the mounting tool of FIG. 7A.
Figure 9:
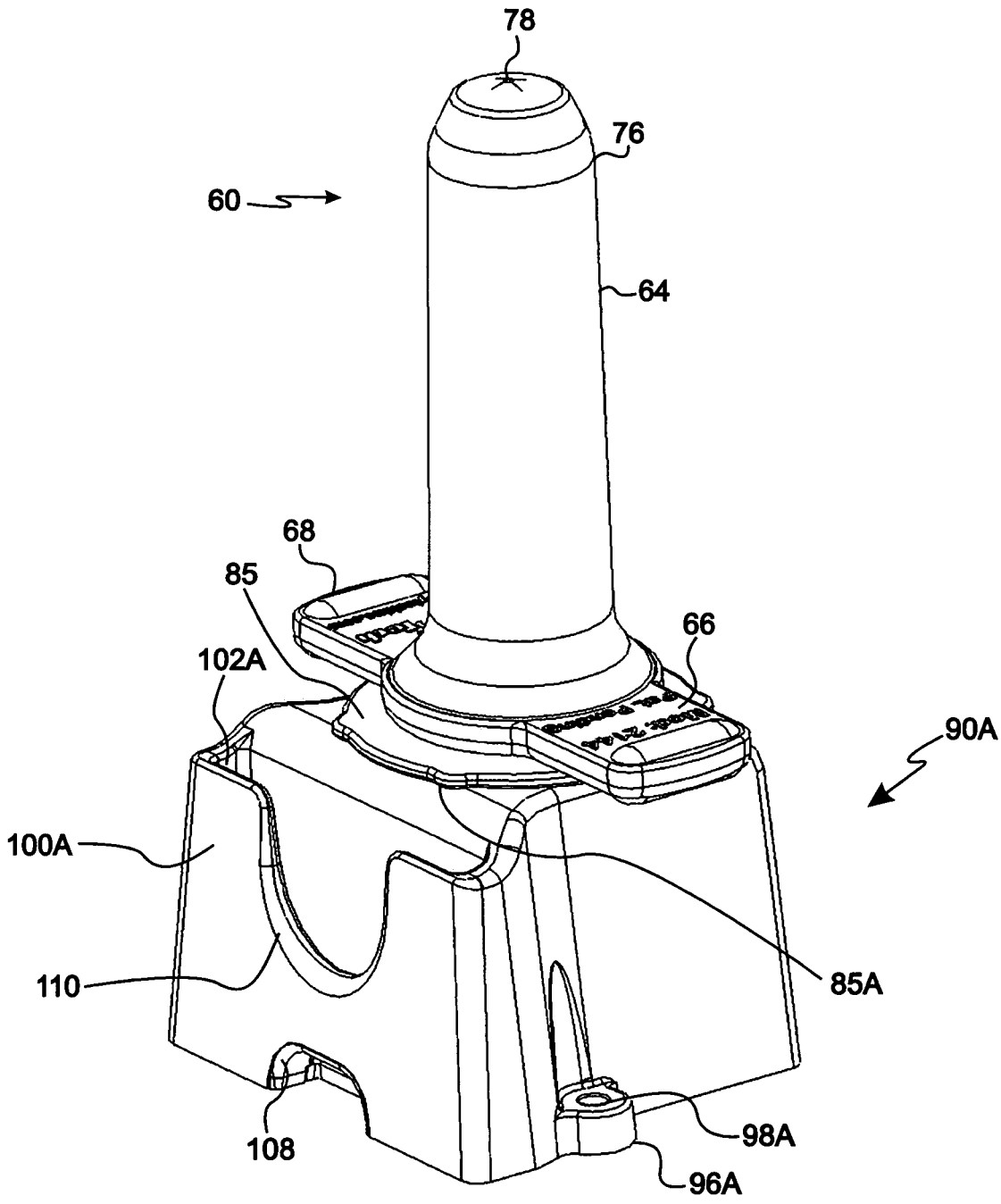
FIG. 9 is a side perspective view of the nipple assembly attached to the top of the mounting tool of FIG. 8.
Figure 10:
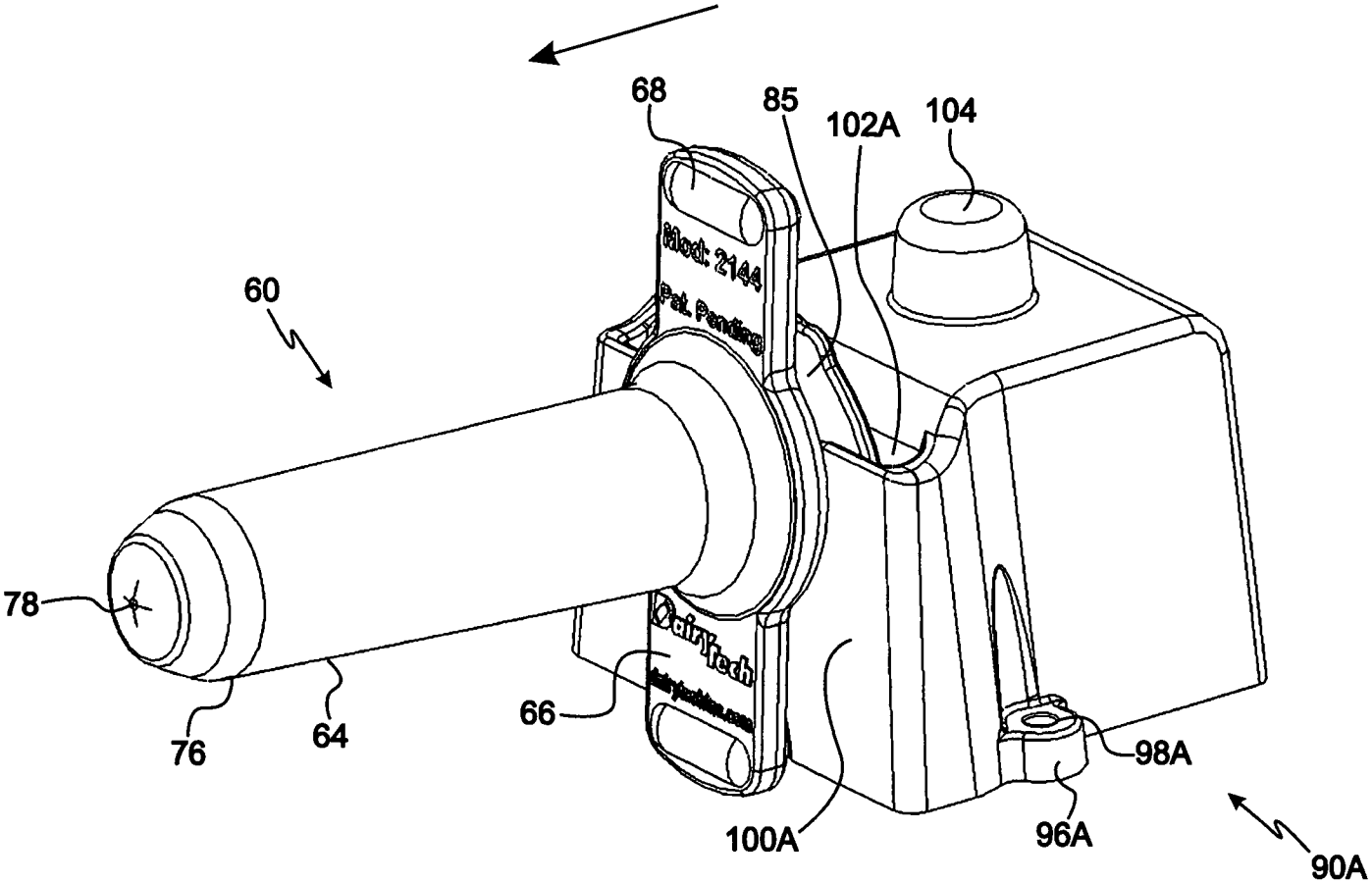
FIG. 10 is a side perspective view of a nipple assembly positioned adjacent the face of the mounting tool of FIG. 7A.

FIGS. 7A, 7B and 7C illustrate an alternative embodiment of the mounting tool, 90A, forming a rather boxy base, with flange mounting slot 102A placed on one side 106 (the "face") of the tool rather than on top as in tool 90. Lift resistors 100A on either side of face 106 form the slot 102. A half-round cutout portion 110 of lift resistors 100A allows the base of nipple adapter 62 to seat therein, retaining the nipple assembly more firmly, as seen in FIG. 10. A curved cutout 108 at the base of face 106 serves as a debris drain and cleaning port for slot 102. Horizontal feet 96A contain holes 98A for mechanical fastening means to secure mounting tool 90A to a surface. A solid conical nipple adapter centering post 104 can be used to seat the nipple 64 on nipple adapter 62 by centering the nipple adapter atop centering post 104, then applying pressure to seat the nipple base on the conical portion of the adapter, as illustrated in FIG. 9.

Figure 8:
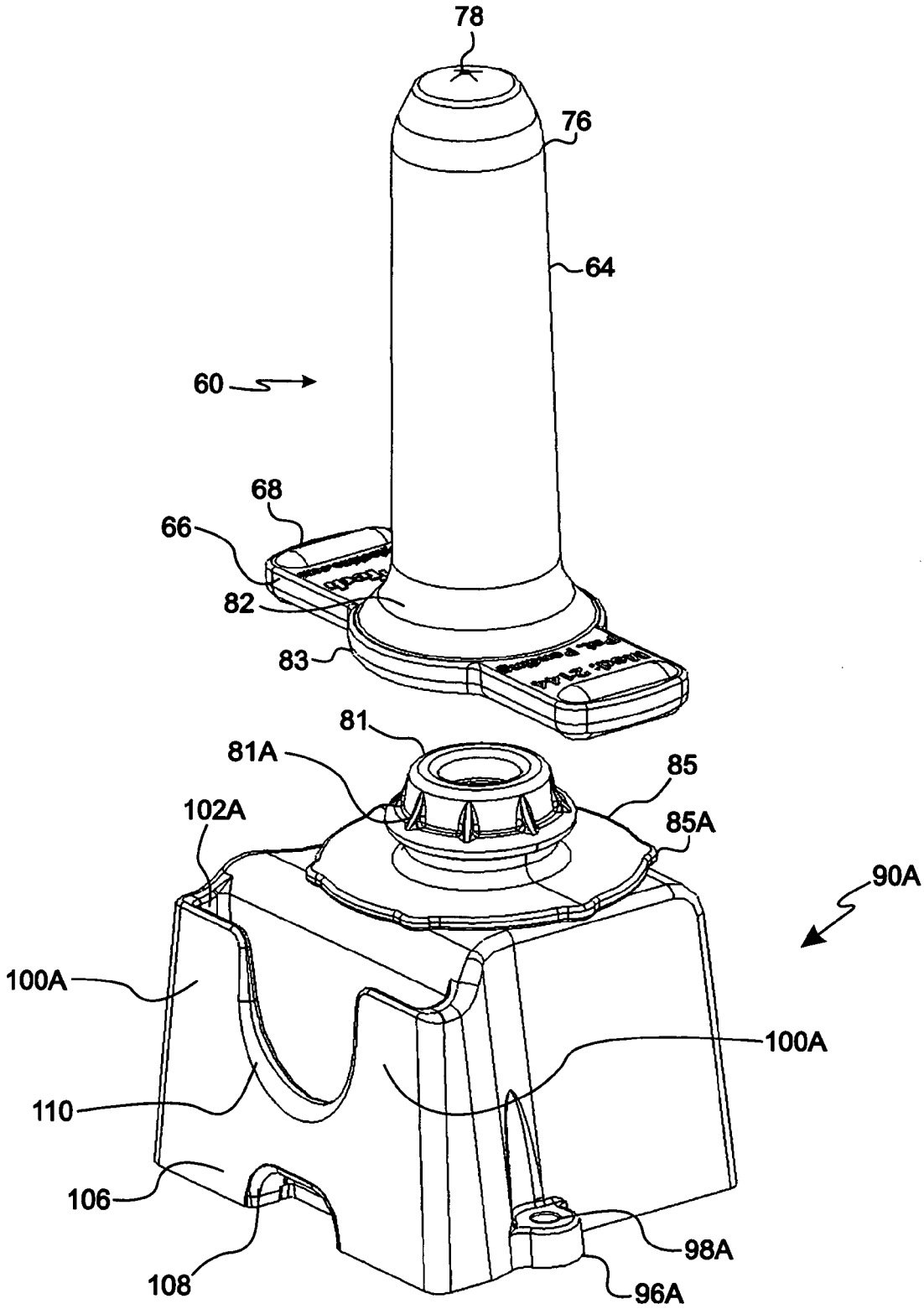
FIG. 8 is a side perspective view of a nipple assembly positioned above the mounting tool of FIG. 7A.

FIGS. 8 and 10 disclose details of certain embodiments of nipple adapter 62, including small finger grip projections 85A on the periphery of adapter flange 85 to facilitate screwing and unscrewing the adapter on threaded spouts or the like. Flange 85 can be molded of plastic materials as an integral part of nipple adapter 62. This embodiment of the adapter employs longitudinal buttress support guides 81A on the conical portion (81) of the adapter. This configuration can be easier to mold than a solid conical form, and effectively guides the nipple base onto the sealing ledge 77 of the adapter.

Figure 11:
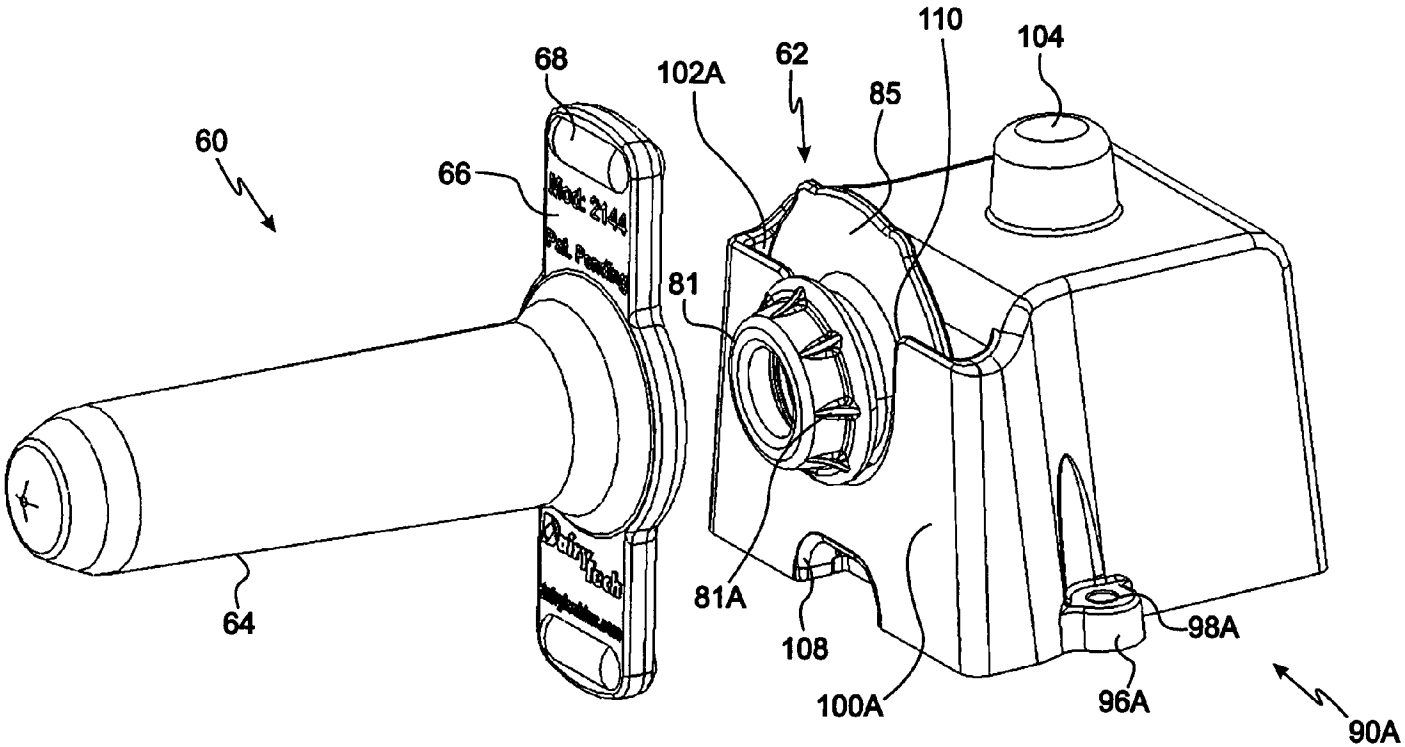
FIG. 11 is a side perspective view of a nipple assembly attached to the face of the mounting tool of FIG. 10.

FIGS. 10 and 11 illustrate the process of removing nipple 64 from adapter 62 after use. With the nipple adapter flange 85 of the complete nipple assembly inserted into flange slot 102 of mounting tool 90A, pressure can be applied to handles 66 of nipple 64, as shown in FIG. 10, mainly on the most accessible top handle, to snap the nipple off so that it can be cleaned or recycled. Nipple adapter 62 can then be slid out of slot 102A.

Both embodiments of the mounting tools described above can be molded of suitable strong plastics, but if greater strength is desired, can be cast from metals, metal alloys, composites or other stronger materials.

FIG. 12 is a perspective view showing a nipple assembly 60 (comprising a nipple 64 and nipple adapter 62) applied to the threaded spout (not visible here) of a feeding bag 10 such as those disclosed in Applicant's copending application U.S. Ser. No. 12/584,552. This figure represents a bag 10 or other container having a compatible threaded spout which is filled with a liquid such as a diary product and fitted with a nipple assembly. Nipple 64, described further above as illustrated in FIGS. 1-3, has a slightly tapered round trunk shaped for proper suckling purposes and constructed of a flexible elastomer such as rubberized PVC, GLS 2701, a Dynaflex® styrene-based thermoplastic elastomer manufactured by GLS Corporation (with Shore Hardness about A-65), Texin® 285 (a polyester-based thermoplastic polyurethane produced by Bayer Materials) or suitable natural or synthetic rubbers or the like. The distal (nursing) tip of nipple 64 begins to round off at circular transition line 76 and the center of the tip includes at least one aperture 78 for dispensing the product as the calf or other animal sucks the nipple 64. The nipple 64 is attached to a self-seating base or nipple adapter 62 which contains internal threads 75 (not seen here) to mount and properly seal with the spout threads 25 of spout 23. This combination is employed to provide a nipple which is flexible and durable enough to respond well to animal feeding and last for at least one feeding, while the stiffer nipple base 72, which is firmly applied to the sealing edge 77 of nipple adapter 62, which is in turn screwed onto the spout 23 of bag 10, ensures that the nipple will be held firmly in place. More details re the nipple assembly are provided in the discussion of FIGS. 1 to 3 and in the copending application cited above.

A method for feeding infant livestock employs the bag 10 of Applicant's RHD-4 application with the nipple assembly 60 attached, from which the calf or other animal can nurse through the nipple at will. Although the bags disclosed in the RHD-4 application are preferred, the nipple assemblies disclosed herein can be applied to filled containers of any type provided they have suitable threaded spouts.

Special equipment can be used in mounting the nipple 64 on the nipple adapter 62, as described below and illustrated in FIGS. 4 to 11. These special mounting tools can be used by mechanically securing the nipple adapter flange 85 thereto while the nipple 64 is applied to the barb fitting portion 81 of nipple adapter 62.

To assemble a fresh bag of colostrum, milk or other dairy product, the operator first secures the nipple 64 to the nipple adapter 62 using the mounting tool (90 or 90A) provided, combining the nipple 64 and nipple adapter 62 as shown in FIG. 2. He then removes the screw cap 24 of bag 10 (not shown here) and screws the nipple assembly 60 onto a threaded spout of a bag such as those disclosed in Applicant's RHD-4 application. This configuration allows a liquid-tight, secure connection of the nipple assembly to the bag, and easy cleaning or recycling of the nipples after use. The entire nipple is then placed into the mouth of the calf for feeding as the bag is inverted to allow the contents to empty.

Figure 13:
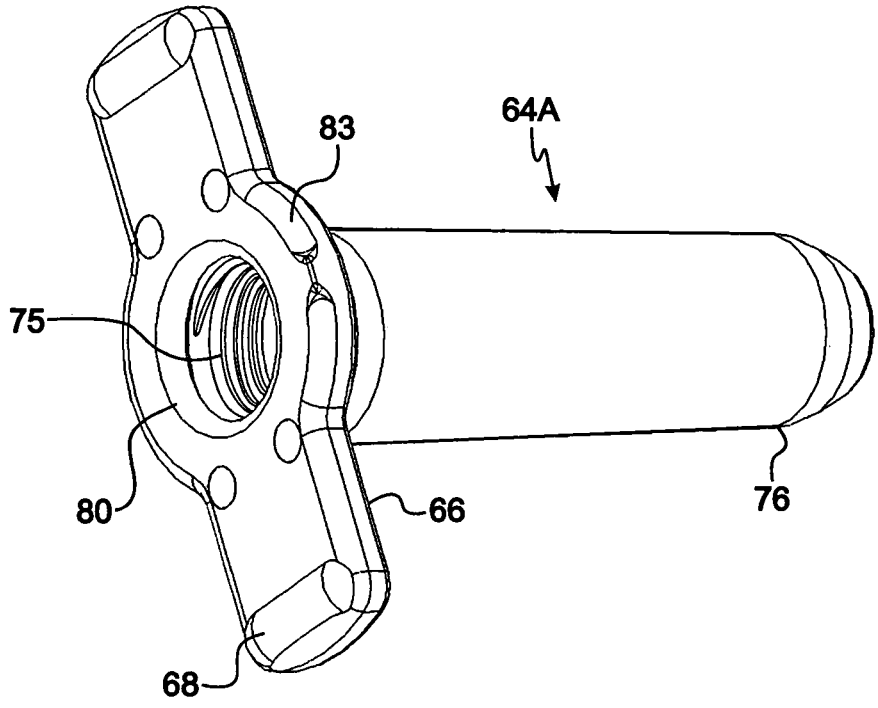
FIG. 13 is a perspective view of a nipple with a threaded interior.
Figure 14:
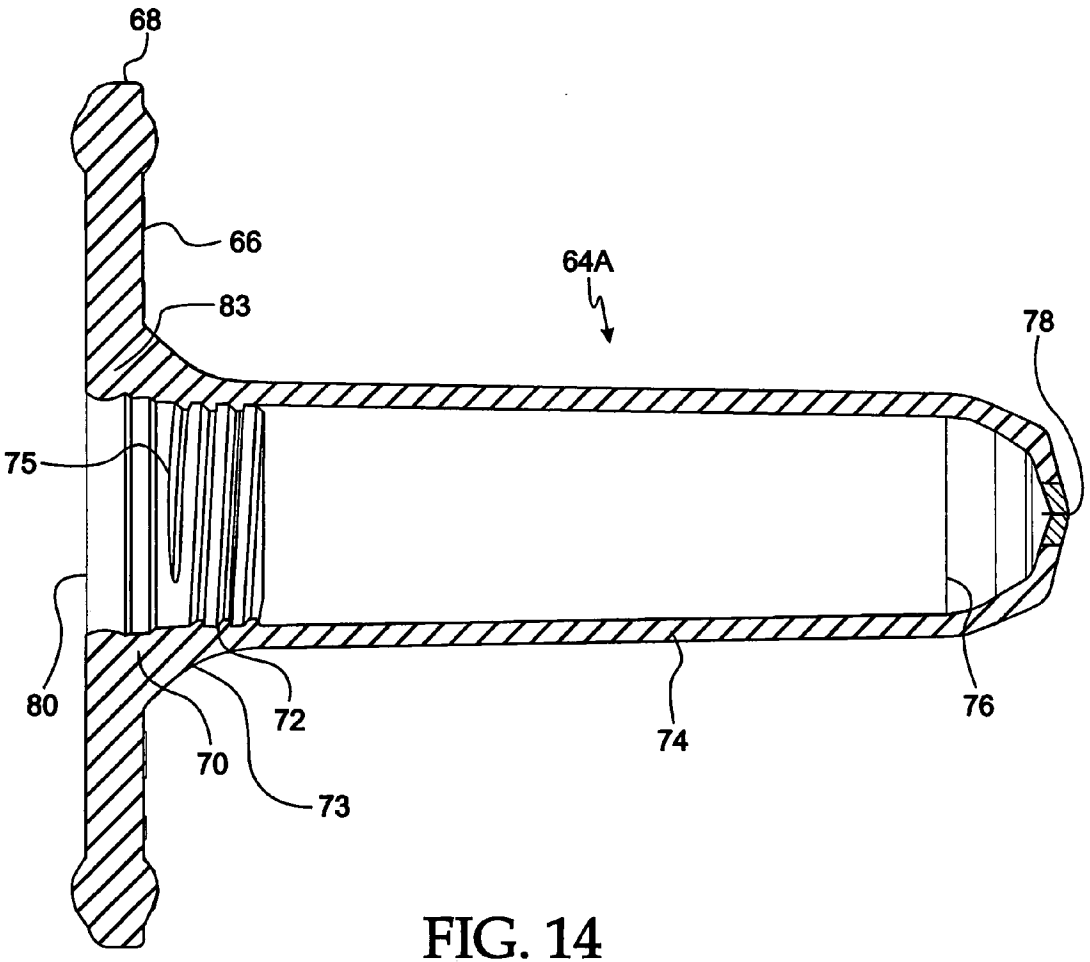
FIG. 14 is a side sectional view of the nipple of FIG. 13.

An alternative embodiment of nipple 64A is illustrated in FIGS. 13 and 14. The nipple form and materials, including handles 66, are substantially the same as in he embodiments disclosed above, but the inner contours designed to engage with a barb fitting are replaced by female threads 75 inside the base of nipple 64A. The materials used for molding the nipple and the thickness and contours of the nipple base are tailored to allow for durable threads to be molded as an integral part of the nipple. This permits the nipple to be simply screwed onto the threaded spout of a suitable feeding container. Handles 66 can be used to assist in the process of installing and removing such nipples, or optionally the handles can be omitted from the nipple and the nipple structural base 83 or other device for gripping he nipple base employed instead.

The qualities of the embodiments disclosed above are further illustrated by the following working examples. A delicate balance must be engineered so that the nipple assembly can be put together and taken apart with ease, while having a strong enough frictional connection to prevent the nipple from being pulled off during feeding. Various materials of varying stiffness qualities and thicknesses were tested thoroughly to achieve these objectives in the embodiments disclosed above.

Clearly, numerous modifications and variations of the disclosed embodiments are possible in light of the above teachings. It is therefore to be understood that within the scope of the appended claims the invention may be practiced otherwise than as specifically described herein for preferred embodiments.

PARTS LIST, RHD-5 (NIPPLE ASSEMBLY) U.S. Ser. No. 12/584,551

10 Heat treatment/storage bag
23 Threaded spout of bag
24 Screw cap
25 Threads of spout 23
60 Nipple assembly
62 Nipple adapter
64 Nipple
64A Threaded nipple
66 Nipple Base Handles
68 Thumb grips
70 Sealing recess
72 Nipple base
73 Transition from sealing area
74 Nipple wall
75 Internal threads
76 Nipple tip transition line
77 Sealing ledge
78 Aperture or slit at tip of nipple
79 Integral seal inside nipple adapter 62
80 Starting bevel inside nipple adapter 62
81 Barb fitting, nipple adapter
81A Buttress support guides
82 Nipple mounting base
83 Nipple structural base
85 Nipple adapter Flange
85A Projections on Nipple Adapter Flange
90 Nipple Assembly mounting tool
90A Alternative (A) Nipple Assembly mounting tool
92 Bridge Support
94 Vertical Supports
96 Horizontal Attachment feet
96A (A) Horizontal Attachment feet
98 Mounting Hardware slots
98A (A) Mounting Hardware holes
99 Mechanical Fastener
100 Lift Resistors
100A (A) Lift Resistors
102 Nipple Adapter Flange slot
102A (A) Nipple Adapter Flange Slot
104 Nipple Adapter centering post
106 Face of tool 90A
108 Cutout for drain
110 Cutout in Lift Resistors

I claim:

1. A mounting tool for assembling and disassembling components of a nipple assembly, wherein:

the nipple assembly is designed for feeding young livestock, and comprises:

a nipple including:

a flexible elastic body that can be provided with a suitable aperture in its tip for dispensing liquid to a nursing animal;

a base including a beveled interior opening and a handle, the beveled interior opening being configured to receive a male barb fitting;

a nipple adapter including:

a flange;

a hollow interior in which reside female threads configured to engage a threaded spout of a feeding container to put the nipple in fluid communication with the spout;

a male barb fitting configured to engage the beveled interior opening;

the mounting tool comprises:

mechanical fasteners configured for at least temporary attachment to a solid surface;

a slot on one side to accommodate the nipple adapter flange with the male barb fitting of the nipple adapter oriented outwardly for connection to the nipple; and a conical nipple adapter centering post on a top surface thereof, the conical nipple adapter centering post being configured to position the nipple adapter while the nipple is being attached thereto.

5

* * * * *